US005531796A

United States Patent [19]

Wasinger et al.

[11] Patent Number: 5,531,796

[45] Date of Patent: Jul. 2, 1996

[54] PROCESS FOR DESIZING AND COLOR FADING GARMENTS

[75] Inventors: Eric Wasinger, Applegate Apartments, 5100 Mira Mesa, Apt. 1413, San Antonio, Tex. 78240; David Hall, Auburn, Ala.

[73] Assignee: Eric Wasinger, San Antonio, Tex.

[21] Appl. No.: 137,369

[22] Filed: Oct. 18, 1993

Related U.S. Application Data

[63] Continuation-in-part of Ser. No. 895,920, Jun. 9, 1992, Pat. No. 5,366,510.

[51] Int. Cl.[6] ..... D06L 3/00

[52] U.S. Cl. ..... 8/102; 8/107; 8/110

[58] Field of Search ..... 8/110, 102, 107

[56] References Cited

U.S. PATENT DOCUMENTS 1,331,609 2/1920 Anders ..... 8/107

*Primary Examiner*—Sharon Gibson
*Assistant Examiner*—Catherine Kilby Scalzo
*Attorney, Agent, or Firm*—John Lezdey

[57] ABSTRACT

A Process for desizing an/or color fading of fabrics and garments utilizing a reducing gas or vapor. The process is particularly for pretreating fabrics which are decolorized to provide a color contrast.

13 Claims, No Drawings

PROCESS FOR DESIZING AND COLOR FADING GARMENTS

This application is a continuation-in-part of application Ser. No. 895,920 filed Jun. 9, 1992, now U.S. Pat. No. 5,366,510 issued Nov. 22, 1994.

FIELD OF THE INVENTION

The present invention relates to a process for desizing and/or the color fading of fabrics and garments. More particularly, there is provided a process for the simultaneous desizing and decolorizing of dyed fabrics and garments utilizing a reducing gas or vapor. The process is particularly useful in preparing fashion garments, such as faded denim blue jeans, without harsh chemical bleaches.

BACKGROUND OF THE INVENTION

Garment and fabric processing today includes dyeing and desizing. Sizing is important in the fabric weaving process. The size is usually removed in a finishing operation after the fabric is woven. In some fabrics e.g., denim, the size is left in to give desirable properties to the denim garment so as to improve the wear properties of the fabrics or garments. However, if the garments or fabrics are further processed, for example, treated with a crosslinking agent and/or decolorized or finished in garment form, it is necessary to first remove the sizing.

The removal of sizing is today performed in most textile operations by one or more of the following methods. The primary method of desizing is enzymatically, for example utilizing amylolytic enzymes. In garment finishing, this process is more costly. Mechanical action is another method of desizing. However, it is preferably used along with desizing by other methods. For example, abrasive drum linings in extractors and/or pumice stones are utilized to improve the garment softness, give the garment special features, etc. Alkaline and acidic hydrolysis have also been employed but such techniques can, depending upon the concentration employed also cause chemical attack of the fabric so as to result in a loss of the abrasive strength and wear resistance of the fabric. Oxidative desizing is generally employed using large concentrations of sodium hypochlorite in the desize solution. The use of hypochlorite creates environmental problems and further can significantly degrade the fabric. Desizing is required where the fabrics or garments are to undergo further processing such as dyeing, printing, decolorization, treatment with a crosslinker, ozone treatments and the like.

Garment dyeing technology, particularly with denim jeans where a differential color appearance is desirable, has focused on treatments in which the dyer starts with a dyed garment and achieves a differential color effect by partial color removal. Removal of color is achieved by use of porous stones soaked in oxidizing agents, such as strong bleach or permanganates, and more recently, by treatment with cellulase enzymes to remove fiber and thereby also remove some sizing and color.

The desizing and removal of color of denim garments generally requires two independent operations wherein the sizing is first removed and then the garment is treated chemically or physically to obtain removal of the color. It would be more economical and less time consuming if the two operations could be accomplished simultaneously. Such a procedure would be advantageous in garment treating processes wherein the garment undergoes a color fading procedure.

U.S. Pat. No. 5,118,322 to Wasinger et al, which is herein incorporated by reference, discloses an apparatus for practicing the present invention with oxidizing gases or vapors.

U.S. application Ser. No. 848,875 filed Mar. 10, 1992, now U.S. Pat. No. 5,313,911 issued May 24, 1994, which is herein incorporated by reference, discloses an apparatus which may be used together with the oxidizing gases of the invention.

It should be understood that the term "dye" as used herein is meant to include any of the materials which are used to provide a color to a fabric such as conventional dyes, pigments, or the like.

It should be understood that the term "reducing gas and steam" as used herein denotes a preferable method of the invention and is meant to include the reducing gas alone or the reducing gas diluted with inert gases.

SUMMARY OF THE INVENTION

The present invention provides a process for the simultaneous desizing and/or decolorizing of fabrics and garments utilizing a reducing gas or vapor. More particularly, the invention provides a means for removing sizing and/or dyes from garments and fabrics so as to provide a special effect in color contrast without any substantial deterioration of the garments or fabrics.

According to one embodiment of the invention, the fabrics or garments are treated with a reducing gas while in an aqueous bath at elevated temperatures. Temperatures of the bath between about 120° to 180° F. are suitable for the simultaneous desizing and dye removal of fabrics.

Alternatively, a reducing gas in combination with steam or vapors containing a reducing agent can be used to provide the reducing action to cause the desizing and/or the decolorization of the garments or fabrics. Elevated temperatures are also desirable for effecting a rapid reduction of the dye or colorant.

Accordingly, the fabric with a portion of the dye removed requires less time if additional fabric processing with bleaching agent or oxidizing agent is desired in order to produce a garment having the appearance of being "stone washed" or "acid washed".

It is therefore a general object of the invention to provide a means for simultaneously desizing and decolorizing a fabric or garment.

It is another object of the invention to desize a garment more efficiently and in a shorter time than with enzymes.

It is yet another object of the invention to prepare a fabric or garment for further treatment by removal of a sizing agent.

It is yet still further object of the invention to selectively and/or evenly decolorize or fade dyed garments to produce fashion garments.

DESCRIPTION OF THE PREFERRED EMBODIMENTS

Although specific terms are used in the following description for the sake of clarity, these terms are intended to refer only to the particular feature of the invention selected for illustration and are not intended to define or limit the scope of the invention.

According to the present invention, sized and/or dyed fabrics and garments which are required to be desized before undergoing further processing can be treated with a reducing gas or vapor so as to remove the sizing. If desired, such as in the case of denim jeans, where the present fashion requirement is a bleached or washed appearance, the garment can be simultaneously decolorized. Typically, blue jeans which would normally undergo only desizing in a washer-extractor, can now undergo simultaneous desizing and decolorization by treatment with a reducing gas or vapor.

In accordance with one embodiment of the invention, denim jeans are placed in a drum type washer-extractor and covered with water at an elevated temperature, preferably at a temperature range between about 120° to 180° F. A reducing gas is added and the mixture is agitated for a period of about 30 minutes, depending upon the reducing agent and type of sizing utilized.

Advantageously, a dye complexing agent such as polyvinyl pyrrolidone is added to prevent redeposit of the degradated dye.

Typical reducing gases which are useful for desizing starch type sizing and decolorizing denim jeans include $SO_x$, $NO_x$, $H_2$, $H_2S$, acetylene and the like.

The reducing agents which can be formulated for use in the vapor phase include sodium hydrosulfite, alkali or other metal sulfoxylate formaldehyde, for example $NaHSO_2$—$CH_2$—$2H_2O$, thiourea dioxide, and the like.

Reducing agents which are primarily useful for decolorization of the fabrics which can be placed into a vapor phase include the alkali metal hydrogen sulfites, sulfides, thiosulfates, oxalates, hydrosulfites and sulfides.

The garments or fabrics to which the present may be applied comprise both natural and/or synthetic fibers including cotton, linen, other bast fibers, rayon, wool, polyester, rayon, alone or in combination with other natural or synthetic fibers.

Preferably, the garment or fabric is desized and/or decolorized without causing degradation of the fabric.

The type of dye used on the garment is not critical. It is only important that the dye is reactive with the reducing gas or vapor where intended. It is recognized that different fiber generia are dyed with specific classes of dyestuff although some dyes have specific application to unions. For example CI Direct Orange 8 will dye the yarns in unions (blends) of cellulose/silk/wool to approximately equal depths of shade. Cellulose substantive dyes include the vats, sulfurs directs, reactive, etc., which are routinely used in the garment industry and are the preferable ones to employ.

Exemplary of the dyes which are or which can be made to become substantive to the cellulosic fibers by mordanting, or by dyeing from alkaline to neutral dyebaths include, Doracid Black 2B (CI Acid Black 24) and Erionyl Navy R (CI Acid Blue 113), Cibacet Blue EBF (CI Diperse Blue 3), and Sevron Brilliant Red 2B (CI Basic Violet 16). Other dyes such as Indigo (CI Vat Blue 1) and the sulfur dyes require alkaline reduction to the water soluble form before it has high cellulose substantivity. Other suitable dyes that have application to the process can be found in the Colour Index, an eight volume reference work published jointly by the Society of Dyers and Colourist (Bradford, England) and the American Association of Textile Chemist and Colorist (Research Triangle Park, N.C.) which is incorporated herein by reference.

The garments may be colored (dyed) with one or more dyes. Utilizing dyes of differing degrees of affinity or reactivities provides the garment with zones of different appearances or effects. For example, faded, stone washed, ice-washed, sand blasted or mottled effects may be obtained. The same effect can be achieved by utilizing blocking agents. The blocking agents may comprise organic materials such as hydrocarbon oils, greases or waxes or inorganic materials such as clay which are not reduced. Masking tape, or other coverings that can adhere to the wet or dry garment may be used.

The blocking agent can also be any chemical agent which itself is reduced with the reducing gas or vapor but prevents or blocks a dye or portion of a dye on the fabric from becoming decolorized.

The reducing gas primarily reacts with the dye of the garment when the garment is wet. Therefore, the garment is wetted or treated in a wet or damp state. The water content of the wetted garment is preferably about 20 to 40% by weight or higher depending upon the degree of treatment and effect desired. The process may either be batchwise or continuous and is performed in a chamber such as described in aforementioned U.S. Pat. No. 5,118,322 in which the reducing gas is generally present in an amount of about 10 to 100 mg. per liter. The reducing gas and the steam are injected into the chamber so as to provide a temperature in the chamber of about 40° to 100° C., preferably 50° to 65° C. In the absence of steam, heating elements in the chamber can be used to maintain the temperature. Any excess gas and/or steam emitted may be recycled back into the chamber. Steam is emitted into the chamber until the temperature is between about 40° and 100° C. When the desired temperature is reached, the reducing gas is emitted into the chamber so as to mix with the steam and react with the dye of the garments or the gas may be emitted with the steam. The concentration of the reducing gas in the chamber is maintained between 10 to 100 mg per liter. When the garments reach a predetermined color, that is, the dye has undergone a decolorizing reaction with the reducing gas whereby the desired color is obtained, the reaction is terminated.

The apparatus used in performing the process of the invention wherein a reducing gas is utilized can comprise an open-ended chamber or a closed-end chamber. In a continuous process, an open-ended chamber is preferred which comprises a plurality of chambers. The temperature of the gas treatment chamber is preferably controlled by the temperature of the steam which is admixed with the reducing gas.

A reducing gas (hydrogen) may be generated in situ by treating garments wet out with 10% acetic acid or mild mineral acids such as 1–5% phosphoric acid, dihydrogen phosphate and the like. The acid treated garments are tumbled while finely powdered (100 mesh) iron filings are sifted onto the garments. Hydrogen gas is generated when the iron (or other metal filings) come into contact with the acid treated garments. As long as the filings are in the wet (damp) state, the degradation of the fabric will be minimized.

Alternatively, the fabric can be tumbled with the iron filings with the acid being introduced as a component of steam vapor.

The use of phosphoric acid moieties will usually provide a more water soluble salt of the iron, zinc, aluminum, etc., metals used to generate the hydrogen that can be rinsed from the fabric following the reducing treatments.

The garments may be treated with one or more dyes. Utilizing dyes of differing degrees of reducibility provides the garment with zones of different appearances or effects. For example, faded, stone washed, ice-washed, sand blasted or mottled effects may be obtained. The same effect can be achieved by utilizing blocking agents. The blocking agents may comprise organic materials such as hydrocarbon oils, greases or waxes or inorganic materials such as clay. Masking tape, or other coverings may be used. A further alternative method to achieve a special effect is to partially or selectively wet the garment since the reduction reaction effectively takes place where the garment is wet. The reducing gas generally does not react with the fabric where it is not wet.

The blocking agent can also be any chemical agent which itself is reducible by the reducing gas or vapor but prevents or blocks a dye or portion of a dye on the fabric from becoming decolorized.

The garment is treated with a blocking agent which is determined on the effect desired. For example, if a sand blasted or stone washed effect is desired, the wet garment can be sprayed with clay or some other inorganic powder to act as a blocker. However, if a mottled look is desired, the garment may be treated with a suitable hydrocarbon oil, grease or wax which shields parts of the garment from the effects of the reducing gas or vapor in a selected manner. The garment can be printed, the color can be applied by painting or using a mordant.

In lieu of the blocking agent, special effects can also be achieved by selectively treating the garment with dyes having different degrees of reducibility. The different dyes can be added earlier in the process so that the use of the blocking agents becomes optional. The non-reactive or lesser reactive dyes may be applied by spraying, brushing, dipping, or the like. Or the fabric may be predyed with the dye mixture. The non-reactive dyes include the pigment colors.

It is understood that the period of treatment with the reducing gas or vapor and amount of gas or vapor utilized is dependent upon different factors. That is, the time and amount of gas or vapor depends upon the effect desired, the class of dye utilized, the temperature, degree of fabric wetness, the temperature and saturation etc. Longer treatment at lower concentrations of reducing gas or vapors can result in the same effect as a short treatment with a large excess of reducing gas or vapor on the same dyes. Therefore, the sensing of the conditions in the reaction chamber is essential to optimize the present process.

The invention is particularly useful in preparing fashion garments such as faded denim blue jeans, and the like, without the use of harsh chemical bleaches or the abrasive effects of stones, pumice, sand or the like.

The reducing gases or vapors are particularly effective where the sizing comprises a starch, starch derivative or a modified starch.

The following examples are illustrative of the practice of the method of the present invention. It will be understood, however, that is not to be construed in any way limitative of the full scope of the invention since various changes can be made without departing from the spirit of the teachings contained herein in light of the guiding principles which have been set forth above. All percentages stated herein are based on weight except wherein otherwise noted.

EXAMPLE 1

A pair of cotton denim blue jeans vat dyed with a blue indigo dye (CI Vat Blue 1) was washed with a standard laundry detergent at 120° F. in a conventional washer which included a spin extractor. The garment after extraction had a moisture content of about 35% by weight.

The garment was then hung in a closed chamber of the type disclosed in U.S. Pat. No. 5,118,322. The chamber was purged with nitrogen and steam heat was emitted into the chamber. When the chamber reached a temperature of about 52° C., carbon monoxide was emitted into the chamber until a concentration of the gas of about 40 mg/1 was obtained and maintained. After a residence time of 30 minutes, the carbon monoxide emission was stopped and the chamber was purged free of carbon monoxide.

The residence time is determined by the use of a test fabric to indicate when the desired color is achieved.

The garment was washed again in a commercial washer with a standard laundry detergent. The resulting garment had a stone washed effect and when examined with a scanning electron microscope did not reveal any signs of fiber degradation. Physical testing revealed no loss of fabric properties.

EXAMPLE 2

Into a 500 gal. capacity rotary drum washer-extractor of the type disclosed in aforementioned application Ser. No. 848,875 was placed 180 blue dyed denim jeans containing a starch sizing. 350 gal. of water at a temperature of 175° F. is added to the washer-extractor. The drum is rotated and sulfur dioxide is bubbled into the drum. The drum is rotated for about 30 minutes and the water is extracted. The garments are then rinsed twice with 220 gal. of cold water and spun to extract the water.

The resulting garments are all desized and decolorized to a very light blue.

The garments can be further decolorized by subjecting them to a standard bleaching operation or by treatment with ozone.

EXAMPLE 3

The procedure of Example 2 was followed except that 12 lbs. sodium hydrosulfite and 10 lbs. of 50% NaOH were employed along with 7 lbs. of a 40% solution of polyvinylpyrrolidone. The mixture was heated and rotated to 130° F. for 15 minutes.

The resulting garments were all desized and decolorized to a pale blue at a more rapid rate.

EXAMPLE 4

A denim trouser was wet out with 10% acetic acid and extracted to 40% water content. Iron filings were sprinkled over the fabric as it tumbled. This was followed by rinsing to remove acid and salts.

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claimed is:

1. A method of simultaneously desizing and decolorizing a wetted fabric or garment having a sizing agent and a reducible coloring agent which comprises treating said fabric or garment with an effective amount of a reducing gas or a reducing vapor to provide a reductive gaseous phase or a reductive vaporous phase where in the fabric or garment is both desized and decolorized.

2. The method of claim 1 wherein said reducing gas is selected from the group consisting of hydrogen, carbon monoxide, sulfur dioxide and acetylene.

3. The method of claim 1 wherein said reducing vapor comprises sodium hydrosulfite and said fabric or garment is treated under basic conditions.

4. The method of claim 1 wherein said reducing vapor comprises an alkali metal sulfoxylate formaldehyde and said fabric or garment is treated under acidic conditions.

5. The method of claim 1 wherein said fabric or garment is subsequently treated with an oxidizing agent.

6. The method of claim 5 wherein said oxidizing agent comprises a chlorine bleach.

7. The method of claim 1 wherein said coloring agent is a dye or pigment.

8. A method for decolorizing a fabric or garment having a reducible dye which comprises wetting said fabric or garment and treating said fabric or garment with an effective amount of a reducing gas to cause decolorization in a reductive gaseous phase.

9. The method of claim 8 wherein said dye is a sulfur dye.

10. The method of claim 8 wherein said reducing gas is generated with the use of a metal in an acidic medium.

11. A decolorized fabric or garment prepared by the process of claim 8.

12. A decolorized and/or desized garment prepared by the process of claim 1.

13. The method of claim 1 wherein said fabric is hung inside a closed chamber, said reducing gas or said reducing vapor is emitted into said chamber so that said fabric comes into contact with said reducing gas or said reducing vapor in a reductive gaseous phase or a reductive vaporous phase for an effective period of time.

* * * * *